US009365777B2

(12) United States Patent
Patten

(10) Patent No.: US 9,365,777 B2
(45) Date of Patent: Jun. 14, 2016

(54) METHODS OF OPERATION FOR REDUCED RESIDUAL HYDROCARBON ACCUMULATION IN OIL SHALE PROCESSING

(71) Applicant: Red Leaf Resources, Inc., South Jordan, UT (US)

(72) Inventor: James W. Patten, South Jordan, UT (US)

(73) Assignee: Red Leaf Resources, Inc., South Jordan, UT (US)

( * ) Notice: Subject to any disclaimer, the term of this patent is extended or adjusted under 35 U.S.C. 154(b) by 343 days.

(21) Appl. No.: 13/916,460

(22) Filed: Jun. 12, 2013

(65) Prior Publication Data

US 2013/0334106 A1 Dec. 19, 2013

Related U.S. Application Data

(60) Provisional application No. 61/659,252, filed on Jun. 13, 2012.

(51) Int. Cl.
*C10G 1/00* (2006.01)
*C10G 1/04* (2006.01)

(52) U.S. Cl.
CPC ..... *C10G 1/045* (2013.01)

(58) Field of Classification Search
CPC ..... C10G 1/00; C10G 1/008; C10G 1/02; C10G 1/04; C10G 1/045
See application file for complete search history.

(56) References Cited

U.S. PATENT DOCUMENTS

| | | | |
|---|---|---|---|
| 6,833,485 | B2 | 12/2004 | Nichols et al. |
| 7,862,705 | B2 | 1/2011 | Dana et al. |
| 2008/0190813 | A1 | 8/2008 | Dana et al. |
| 2008/0190816 | A1 | 8/2008 | Dana et al. |
| 2008/0190818 | A1 | 8/2008 | Dana et al. |
| 2009/0007484 | A1 | 1/2009 | Smith |
| 2009/0250380 | A1 | 10/2009 | Dana et al. |
| 2010/0089575 | A1 | 4/2010 | Kaminsky |
| 2010/0200387 | A1 | 8/2010 | Dana et al. |
| 2010/0200464 | A1 | 8/2010 | Dana et al. |
| 2011/0138649 | A1 | 6/2011 | Patten |
| 2011/0286796 | A1 | 11/2011 | Patten |

OTHER PUBLICATIONS

SME Mining Engineering Handbook, 3d Ed., 2011, Peter Darling, ed., p. 649.*
PCT/US2013/045621; filed Jun. 13, 2013; Red Leaf Resources, Inc.; international search report dated Sep. 5, 2013.

* cited by examiner

*Primary Examiner* — Renee E Robinson
*Assistant Examiner* — Derek Mueller
(74) *Attorney, Agent, or Firm* — Thorpe North & Western, LLP

(57) ABSTRACT

A method of reducing residual hydrocarbon accumulation during processing can comprise forming a permeable body (608) of a comminuted hydrocarbonaceous material within an enclosure (602). A primary liquid collection system (610) is located in a lower portion of the permeable body. The primary liquid collection system (610) has an upper surface for collecting and removing liquids. Comminuted hydrocarbonaceous material below the primary liquid collection system (610) forms a non-production zone (616). At least a portion of the permeable body (608) is heated to a bulk temperature above a production temperature sufficient to remove hydrocarbons therefrom within a production zone (614), where conditions in the non-production zone (616) are maintained below the production temperature.

27 Claims, 7 Drawing Sheets

METHODS OF OPERATION FOR REDUCED RESIDUAL HYDROCARBON ACCUMULATION IN OIL SHALE PROCESSING

RELATED APPLICATION

This application claims priority to U.S. Provisional Patent Application No. 61/659,252, filed Jun. 13, 2012 which is incorporated herein by reference.

BACKGROUND

Global and domestic demand for fossil fuels continues to rise despite price increases and other economic and geopolitical concerns. As such demand continues to rise, research and investigation into finding additional economically viable sources of fossil fuels correspondingly increases. Historically, many have recognized the vast quantities of energy stored in oil shale, coal and tar sand deposits, for example. However, these sources remain a difficult challenge in terms of economically competitive recovery. Canadian tar sands have shown that such efforts can be fruitful, although many challenges still remain, including environmental impact, product quality, and process time, among others.

Estimates of world-wide oil shale reserves range from two to almost seven trillion barrels of oil, depending on the estimating source. Regardless, these reserves represent a tremendous volume and remain a substantially untapped resource. A large number of companies and investigators continue to study and test methods of recovering oil from such reserves.

Recent developments in oil shale processing include the In-Capsule® process where crushed oil shale is placed within an earthen impoundment and heated to remove hydrocarbons from the oil shale. This technology is generally described in U.S. Pat. No. 7,862,705. Produced hydrocarbons can be removed through various drain systems and collection systems. However, the earthen impoundment is designed to be left in place and substantially undisturbed upon completion of the removal process. Long term stability and elimination or reduction of environmental impacts can be an important consideration in design and operation of such a system.

SUMMARY

A method of reducing residual hydrocarbon accumulation during processing can comprise forming a permeable body of a comminuted hydrocarbonaceous material within an enclosure. A primary liquid collection system is located in a lower portion of the permeable body. The primary liquid collection system has an upper surface for collecting and removing liquids. Although a bulk portion of the comminuted hydrocarbonaceous material is oriented above the primary collection system, a portion of the comminuted hydrocarbonaceous material is located below the primary liquid collection system and forms a non-production zone. At least a portion of the permeable body is heated to a bulk temperature above a production temperature sufficient to remove hydrocarbons therefrom, while conditions in the non-production zone are maintained below the production temperature.

Additionally, a constructed permeability control infrastructure can comprise a permeability control impoundment defining a substantially encapsulated volume. Typically, the impoundment is at least partially formed of an earthen material. A comminuted hydro carbonaceous material is oriented within the encapsulated volume forming a permeable body of hydrocarbonaceous material. The hydrocarbonaceous material can be oil shale, coal, tar sands, lignin, bitumen, peat or any other hydrocarbon rich material. A primary liquid collection system is located in a lower portion of the permeable body while a portion of the permeable body is located below the primary liquid collection system. The primary liquid collection system has an upper surface for collecting and removing liquids during production and heating. The portion of comminuted hydrocarbonaceous material below the primary liquid collection system forms a non-production zone where conditions can be maintained to avoid formation or collection of substantial hydrocarbon product within the non-production zone.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
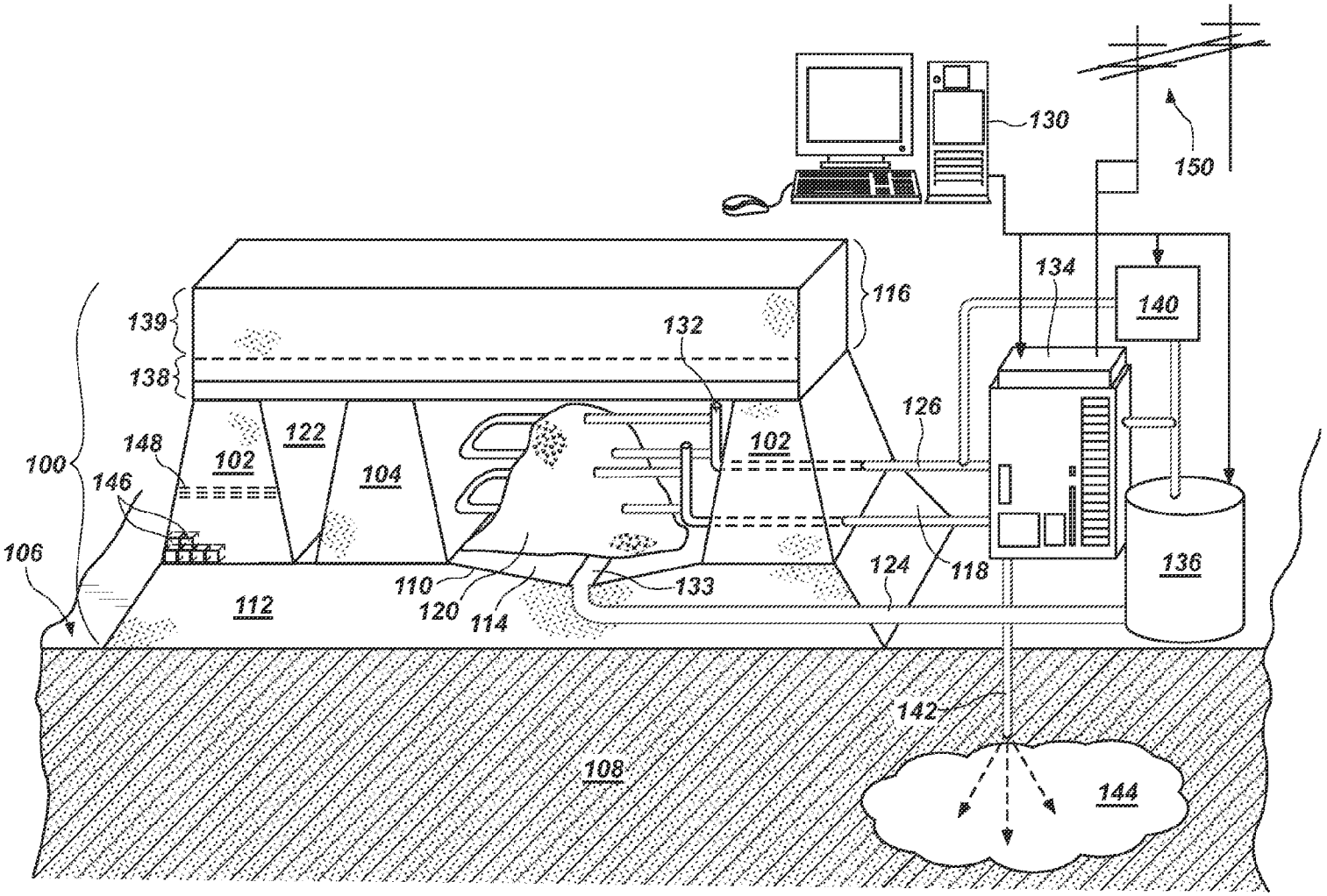
FIG. 1 is side partial cutaway view schematic of a constructed permeability control infrastructure in accordance with one embodiment of the present invention.

It should be noted that the figures are merely exemplary of several embodiments of the present invention and no limitations on the scope of the present invention are intended thereby. Further, the figures are generally not drawn to scale, but are drafted for purposes of convenience and clarity in illustrating various aspects of the invention.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

DEFINITIONS

In describing and claiming the present invention, the following terminology will be used. The singular forms "a," "an," and "the" include plural references unless the context clearly dictates otherwise. Thus, for example, reference to "a wall" includes reference to one or more of such structures, "a permeable body" includes reference to one or more of such materials, and "a heating step" refers to one or more of such steps.

As used herein, "below grade" and "subgrade" refer to a foundation of supporting soil or earth beneath a constructed structure. Therefore, as rock, soil or other material is removed or excavated from a location, the surface grade level follows the contours of the excavation. The terms "in situ," "in formation," and "subterranean" therefore refer to activities or locations which are below grade.

As used herein, "constructed infrastructure" refers to a structure which is substantially entirely man made, as opposed to freeze walls, sulfur walls, or other barriers which are formed by modification or filling pores of an existing geological formation.

The constructed permeability control infrastructure is preferably substantially free of undisturbed geological formations, although the infrastructure can be formed adjacent or in direct contact with an undisturbed formation. Such a control infrastructure can be unattached or affixed to an undisturbed formation by mechanical means, chemical means or a combination of such means, e.g. bolted into the formation using anchors, ties, or other suitable hardware.

As used herein, "comminuted" refers to breaking a formation or larger mass into pieces. A comminuted mass can be rubbilized or otherwise broken into fragments.

As used herein, "earthen material" refers to natural materials which are recovered from the earth with only mechanical modifications such as, but not limited to, clay (e.g. bentonite clay), gravel, rock, compacted fill, soil, and the like. Gravel, for example, may be combined with cement to form concrete. Frequently, bentonite amended soil can be combined with water to form a hydrated bentonite layer which acts as a fluid barrier.

As used herein, "hydrocarbonaceous material" refers to any hydrocarbon-containing material from which hydrocarbon products can be extracted or derived. For example, hydrocarbons may be extracted directly as a liquid, removed via solvent extraction, directly vaporized or otherwise removed from the material. However, many hydrocarbonaceous materials contain kerogen or bitumen which is converted to a hydrocarbon through heating and pyrolysis. Hydrocarbonaceous materials can include, but is not limited to, oil shale, tar sands, coal, lignite, bitumen, peat, and other organic rich rock.

As used herein, "impoundment" refers to a structure designed to hold or retain an accumulation of fluid and/or solid moveable materials. An impoundment generally derives at least a substantial portion of foundation and structural support from earthen materials. Thus, the control walls of the present invention do not always have independent strength or structural integrity apart from the ground and/or native formation against which they are formed.

As used herein, "permeable body" refers to any mass of comminuted hydrocarbonaceous material having a relatively high permeability which exceeds permeability of a solid undisturbed formation of the same composition. Permeable bodies suitable for use in the present invention can have greater than about 10% void space and typically have void space from about 20% to 40%, although other ranges may be suitable. Allowing for high permeability facilitates heating of the body through convection as the primary heat transfer while also substantially reducing costs associated with crushing to very small sizes, e.g. below about 1 to about 0.5 inch.

As used herein, "wall" refers to any constructed feature having a permeability control contribution to confining material within an encapsulated volume defined at least in part by control walls. Walls can be oriented in any manner such as vertical, although ceilings, floors and other contours defining the encapsulated volume can also be "walls" as used herein.

As used herein, "mined" refers to a material which has been removed or disturbed from an original stratographic or geological location to a second and different location. Typically, mined material can be produced by rubbilizing, crushing, explosively detonating, or otherwise removing material from a geologic formation.

As used herein, "substantially stationary" refers to nearly stationary positioning of materials with a degree of allowance for subsidence and/or settling as hydrocarbons are removed from the hydrocarbonaceous material. Such settling can cause subsidence of over 40% in some cases, but such movement of materials is limited to compaction rather than bulk movement or circulation of material. In contrast, any circulation and/or flow of hydrocarbonaceous material such as that found in fluidized beds or rotating retorts involves highly substantial movement and handling of hydrocarbonaceous material.

As used herein, "substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context. Similarly, "substantially free of" or the like refers to the lack of an identified element or agent in a composition. Particularly, elements that are identified as being "substantially free of" are either completely absent from the composition, or are included only in amounts which are small enough so as to have no measurable effect on the composition.

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, and sub-ranges such as 10 to 50, 20 to 100, etc.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Reducing Residual Hydrocarbon

A method of reducing residual hydrocarbon accumulation during processing can comprise forming a permeable body of a comminuted hydrocarbonaceous material within an enclosure. A primary liquid collection system is located in a lower portion of the permeable body. The primary liquid collection system has an upper surface for collecting and removing liquids while comminuted hydro carbonaceous material below the primary liquid collection system forms a non-production zone. At least a portion of the permeable body is heated to a bulk temperature above a production temperature sufficient to remove hydrocarbons therefrom. Throughout the process, conditions in the non-production zone are maintained below the production temperature.

Generally, the present method can provide an effective means for recovering hydrocarbons from hydro carbonaceous materials without accumulating unwanted residual hydrocarbons within the constructed permeability control infrastructure. Accumulation of flowable hydrocarbons can be eliminated or reduced below the primary liquid collections system or elsewhere in locations where they are not removed from the impoundment during operation. Generally, the constructed infrastructure defines a substantially encapsulated volume where a mined or harvested hydrocarbonaceous material can be introduced into the control infrastructure to form a permeable body of hydrocarbonaceous material. The control infrastructure can generally be formed at least partially of earthen material to form a barrier to uncontrolled escape of fluids from the impoundment. The permeable body can be heated sufficient to remove hydrocarbons therefrom. During heating, the hydro carbonaceous material is substantially stationary as the constructed infrastructure is a fixed structure. Removed hydrocarbons can be collected for further processing, use in the process, and/or use as recovered.

As such, a constructed permeability control infrastructure can comprise a permeability control impoundment defining a substantially encapsulated volume, a comminuted hydro carbonaceous material within the encapsulated volume forming a permeable body of hydrocarbonaceous material, and a primary liquid collection system located in a lower portion of the permeable body. Further, the constructed permeability control infrastructure can optionally further comprise a secondary liquid collection system located below the primary liquid collection system.

Each of these aspects of the present invention is described in further detail below. The constructed permeability control infrastructure can be formed using existing grade as floor support and/or as side wall support for the constructed infrastructure. For example, the control infrastructure can be formed as a free standing structure, i.e. using only existing grade as a floor with side walls being man-made. Alternatively, the control infrastructure can be formed within an excavated pit. Regardless, the control infrastructures of the present invention are always formed above-grade.

A constructed permeability control infrastructure of the present invention can include a permeability control impoundment which defines a substantially encapsulated volume. The permeability control impoundment of the present invention can be substantially free of undisturbed geological formations. Specifically, the permeability control aspect of the impoundment can be completely constructed and man-made as a separate isolation mechanism for prevention of uncontrolled migration of material into or out of the encapsulated volume. In one embodiment, the constructed permeability control infrastructure can include a permeable body of hydrocarbonaceous material, a layer of gravel fines, a fluid barrier layer of bentonite amended soil (BAS layer), and adjacent native formation.

As such, in one embodiment, the present constructed permeability control infrastructure can be heated and/or cooled under specific temperature profiles to substantially eliminate or minimize the formation of unwanted accumulated hydrocarbon material. As discussed herein, the present infrastructures can be operated to heat at least a portion of the permeable body to a bulk temperature above a production temperature sufficient to remove hydrocarbons therefrom, where conditions in the non-production zone are maintained below the production temperature. In one aspect, the infrastructure can have a production temperature ranging from at least 200° F. to 900° F. In another aspect, the infrastructure can have a bulk temperature ranging from over 200° F. to 900° F. In one detailed aspect, the bulk temperature can be between 400° F. and 900° F.

In order to decrease or eliminate the amount of liquids retained in the non-production zone, several conditions can be maintained. As discussed above, during operation of the system, temperatures below the liquid collection system can be maintained below a production temperature for the corresponding hydrocarbonaceous materials. As a result, materials in the non-production zone do not produce hydrocarbons. Further, as the fluid barrier properties of the impoundment barrier layer can be maintained. For example, when using bentonite amended soil (BAS) the fluid barrier properties are maintained as long as the BAS layer is hydrated. During operation, hydration can be maintained by keeping temperatures throughout the BAS layer below about 212° F., or more typically below about 200° F. in order to avoid hot spots and localized dehydration of the BAS. Additionally or alternately, the present infrastructures can further include a hydration maintenance mechanism to hydrate the BAS layer. Such hydration mechanism can include conduits, piping, or irrigation channels to provide water to the BAS layer. The hydration maintenance mechanism can be located in discrete locations or continuously around the perimeter of the infrastructure such that adequate and uniform hydration of the BAS layer is achieved.

In addition to the above, in one embodiment, the permeable body can include a secondary liquid collection system located below the primary liquid collection system. In one aspect, the secondary liquid collection system can have an upper surface with a greater surface area than the upper surface of the primary liquid collection system. As such, in one aspect, the secondary liquid collection system can circumscribe the primary liquid collection system from a top plan view as described more fully below in connection with FIG. 7.

Optional dedicated cooling conduits can be used to help control the heating as described herein. In another embodiment, the heating materials used in the heating conduits can be replaced with cooling materials. Additionally, precipitating salts capable of forming high temperature grout can be used in conjunction with the infrastructure including the formation of the BAS layers and gravel fine layers. In one aspect, the precipitating salts can be deposited before or after such layers. Further, the precipitating salts can be used in selective portions of the infrastructure, e.g. the floor of the infrastructure. Such precipitating salts can create a fluid boundary. Non-limiting examples of such salts include calcium carbonate, calcium chloride, sodium chloride, and the like. In one embodiment, a displacement fluid can be used to force unwanted or accumulated hydrocarbons into a collection system, e.g., the primary liquid collection system. In another embodiment, hydrocarbon gelling agents could be used to immobilize the accumulated hydrocarbon as well as help eliminate pathways of unwanted hydrocarbon formation within the infrastructure, e.g., at the interface between the primary liquid collection system and the BAS layer. Non-limiting examples of hydrocarbon gelling agents can include aluminum carboxylate salts, phosphate esters (e.g. gelling agents available from Weatherford International and ChemPlex Ltd.), aluminum phosphate ester, and the like.

In one embodiment, the permeability control impoundment can be formed along walls of an excavated hydrocarbonaceous material deposit. For example, oil shale, tar sands, or coal can be mined from a deposit to form a cavity which corresponds approximately to a desired encapsulation volume for an impoundment. The excavated cavity can then be used as a form and support to create the permeability control impoundment.

In one alternative aspect, at least one additional excavated hydrocarbonaceous material deposit can be formed such that a plurality of impoundments can be operated. Further, such a configuration can facilitate a reduction in transportation distance of the mined material. Specifically, the mined hydro carbonaceous material for any particular encapsulated volume can be mined from an adjacent excavated hydrocarbonaceous material deposit. In this manner, a grid of constructed structures can be built such that mined material can be immediately and directly filled into an adjacent impoundment.

Mining and/or excavation of hydrocarbonaceous deposits can be accomplished using any suitable technique. Conventional surface mining can be used, although alternative excavators can also be used without requirement of transportation of the mined materials.

The impoundment can be formed of any suitable material which provides isolation of material transfer across walls of the impoundment. In this manner, integrity of the walls is retained during operation of the control infrastructure sufficient to substantially prevent uncontrolled migration of fluids outside of the control infrastructure. Non-limiting examples of suitable material for use in forming the impoundment of the constructed permeability control infrastructure can include clay, bentonite clay (e.g. clay comprising at least a portion of bentonite which includes montmorillonite), compacted fill, refractory cement, cement, synthetic geogrids, fiberglass, rebar, nanocarbon fullerene additives, filled geotextile bags, polymeric resins, oil resistant PVC liners, or combinations thereof. For large scale operations forming the impoundment at least partially of earthen material can provide an effective barrier. Engineered cementitious composites (ECC) materials, fiber reinforced composites, and the like can be particularly strong and can be readily engineered to meet permeability and temperature tolerance requirements of a given installation.

As a general guideline, materials having low permeability and high mechanical integrity at operating temperatures of the infrastructure are preferred although not required. For example, materials having a melting point above the maximum operating temperature of the infrastructure can be useful to maintain containment during and after heating and recovery. However, lower temperature materials can also be used if a non-heated buffer zone is maintained between the walls and heated portions of the permeable body. Such buffer zones can range from 6 inches to 50 feet depending on the particular material used for the impoundment and the composition of the permeable body. In another aspect of the present invention, walls of the impoundment can be acid, water and/or brine resistant, e.g. sufficient to withstand exposure to solvent recovery and/or rinsing with acidic or brine solutions, as well as to steam or water. For impoundment walls formed along formations or other solid support, the impoundment walls can be formed of a sprayed grouting, sprayed liquid emulsions, or other sprayed material such as sprayable refractory grade grouting which forms a seal against the formation and creates the permeability control wall of the impoundments. Impoundment walls may be substantially continuous such that the impoundment defines the encapsulated volume sufficiently to prevent substantial movement of fluids into or out of the impoundment other than defined inlets and outlets, e.g. via conduits or the like as discussed herein. In this manner, the impoundments can readily meet government fluid migration regulations. Alternatively, or in combination with a manufactured barrier, portions of the impoundment walls can be undisturbed geological formation and/or compacted earth. In such cases, the constructed permeability control infrastructure is a combination of permeable and impermeable walls as described in more detail below.

In one detailed aspect, a portion of hydrocarbonaceous material, either pre- or post-processed, can be used as a cement fortification and/or cement base which are then poured in place to form portions or the entirety of walls of the control infrastructure. These materials can be formed in place or can be preformed and then assembled on site to form an integral impoundment structure. For example, the impoundment can be constructed by cast forming in place as a monolithic body, extrusion, stacking of preformed or precast pieces, concrete panels joined by a grout (cement, ECC or other suitable material), inflated form, or the like. The forms can be built up against a formation or can be stand alone structures. Forms can be constructed of any suitable material such as, but not limited to, steel, wood, fiberglass, polymer, or the like. The forms can be assembled in place or may be oriented using a crane or other suitable mechanism. Alternatively, the constructed permeability control infrastructure can be formed of gabions and/or geosynthetic fabrics assembled in layers with compacted fill material. Optional binders can be added to enhance compaction of the permeability control walls. The control infrastructure can optionally comprise, or consist essentially of, sealant, grout, rebar, synthetic clay, bentonite clay, clay lining, refractory cement, high temperature geomembranes, drain pipes, alloy sheets, or combinations thereof.

In one embodiment, the construction of impoundment walls and floors can include multiple compacted layers of indigenous or manipulated low grade shale with any combination of sand, cement, fiber, plant fiber, nano carbons, crushed glass, reinforcement steel, engineered carbon reinforcement grid, calcium, and the like. In addition to such composite walls, designs which inhibit long term fluid and gas migration through additional impermeability engineering can be employed including, but not limited to, liners, geomembranes, compacted soils, imported sand, gravel or rock and gravity drainage contours to move fluids and gases away from impervious layers to egress exits. Impoundment floor and wall construction, can, but need not comprise, a stepped up or stepped down slope or bench as the case of mining course may dictate following the optimal ore grade mining. In any such stepped up or down applications, floor leveling and containment wall construction can typically drain or slope to one side or to a specific central gathering area(s) for removal of fluids by gravity drainage assistance.

Optionally, capsule wall and floor construction can include insulation which prevents heat transfer outside of the constructed infrastructure or outside of inner capsules or conduits within the primary constructed capsule containment. Insulation can comprise manufactured materials, cement or various materials other materials which are less thermally conductive than surrounding masses, i.e. permeable body, formation, adjacent infrastructures, etc. Thermally insulating barriers can also be formed within the permeable body, along impoundment walls, ceilings and/or floors. Optional insulation materials can include biodegradable insulating materials, e.g. soy insulation and the like. This is consistent with embodiments wherein the impoundment is a single use system such that insulations, pipes, and/or other components can have a relatively low useful life, e.g. less than 1-2 years. This can reduce equipment costs as well as reduce long-term environmental impact.

The structures and methods presented herein can be applied at almost any scale. Larger encapsulated volumes and increased numbers of impoundments can readily produce hydrocarbon products and performance comparable to or exceeding smaller constructed infrastructures. As an illustration, single impoundments can range in size from tens of meters across to tens of acres in top plan surface area. Optimal impoundment sizes may vary depending on the hydrocarbonaceous material and operating parameters, however it is expected that suitable areas can range from about one-half to five acres in top plan surface area.

The methods and infrastructures can be used for recovery of hydrocarbons from a variety of hydrocarbonaceous materials. One particular advantage is a wide degree of latitude in controlling particle size, conditions, and composition of the permeable body introduced into the encapsulated volume. Non-limiting examples of mined hydrocarbonaceous material which can be treated comprise oil shale, tar sands, coal, lignite, bitumen, peat, or combinations thereof. In some cases it can be desirable to provide a single type of hydrocarbonaceous material so that the permeable body consists essentially of one of the above materials. However, the permeable body can include mixtures of these materials such that grade, oil content, hydrogen content, permeability and the like can be adjusted to achieve a desired result. Further, different hydrocarbon materials can be placed in multiple layers or in a mixed fashion such as combining coal, oil shale, tar sands, biomass, and/or peat.

In one embodiment, hydrocarbon containing material can be classified into various inner capsules within a primary constructed infrastructure for optimization reasons. For instance, layers and depths of mined oil shale formations may be richer in certain depth pay zones as they are mined. Once, blasted, mined, shoveled and hauled inside of a capsule for placement, richer oil bearing ores can be classified or mixed by richness for optimal yields, faster recovery, or for optimal averaging within each impoundment. Further, providing layers of differing composition can have added benefits. For example, a lower layer of tar sands can be oriented below an upper layer of oil shale. Generally, the upper and lower layers can be in direct contact with one another although this is not required. The upper layer can include heating pipes embedded therein as described in more detail below. The heating pipes can heat the oil shale sufficient to liberate kerogen oil, including short-chain liquid hydrocarbons, which can act as a solvent for bitumen removal from the tar sands. In this manner, the upper layer acts as an in situ solvent source for enhancing bitumen removal from the lower layer. Heating pipes within the lower layer are optional such that the lower layer can be free of heating pipes or may include heating pipes, depending on the amount of heat transferred via downward passing liquids from the upper layer and any other heat sources. The ability to selectively control the characteristics and composition of the permeable body adds a significant amount of freedom in optimizing oil yields and quality. Furthermore, the liberated gaseous and liquid products can act as an in situ produced solvent which supplements kerogen removal and/or additional hydrocarbon removal from the hydrocarbonaceous material.

Optionally, the permeable body can further comprise an additive or biomass. Additives can include any composition which acts to increase the quality of removed hydrocarbons, e.g. increased API, decreased viscosity, improved flow properties, reduced wetting of residual shale, reduction of sulfur, hydrogenation agents, etc. Non-limiting examples of suitable additives can include bitumen, kerogen, propane, natural gas, natural gas condensate, crude oil, refining bottoms, asphaltenes, common solvents, other diluents, and combinations of these materials. In one specific embodiment, the additive can include a flow improvement agent and/or a hydrogen donor agent. Some materials can act as both or either agents to improve flow or as a hydrogen donor. Non-limiting examples of such additives can include methane, natural gas condensates, common solvent such as acetone, toluene, benzene, etc., and other additives listed above. Similarly, biological hydroxylation of hydrocarbonaceous materials to form synthetic gas or other lighter weight products can be accomplished using known additives and approaches. Other enzymes or biocatalysts can also be used in a similar manner. Further, manmade materials can also be used as additives such as, but not limited to, tires, polymeric refuse, or other hydrocarbon-containing materials.

Particle sizes throughout the permeable body can vary considerably, depending on the material type, desired heating rates, and other factors. As a general guideline, the permeable body can include particles from about ⅛ inch to about 6 feet, and in some cases less than 1 foot and in other cases less than about 6 inches. However, as a practical matter, sizes from about 2 inches to about 2 feet can provide good results with about 1 foot diameter being useful for oil shale especially. Void space can be an important factor in determining optimal particle diameters. As a general matter, any functional void space can be used. However, about 15% to about 40% and in some cases about 30% usually provides a good balance of permeability and effective use of available volumes. Void volumes can be varied somewhat by varying other parameters such as heating conduit placement, particle size distributions (i.e. multimodal distributions), additives, and the like.

Mechanical separation of mined hydrocarbonaceous materials allows creation of fine mesh, high permeability particles which enhance thermal dispersion rates once placed in capsule within the impoundment. The added permeability allows for more reasonable, low temperatures which also help to avoid higher temperatures which result in greater $CO_2$ production from carbonate decomposition and associated release of trace heavy metals, volatile organics, and other compounds which can create toxic effluent and/or undesirable materials which must be monitored and controlled.

In one alternative aspect, the impoundments can be formed in excavated volumes of a hydrocarbonaceous formation, although other locations remote from the control infrastructure can also be useful. For example, some hydrocarbonaceous formations have relatively thin hydrocarbon-rich layers, e.g. less than about 300 feet. Therefore, vertical mining and drilling tend to not be cost effective. In such cases, horizontal mining can be useful to recover the hydrocarbonaceous materials for formation of the permeable body. Other mining approaches such as, but not limited to, room and pillar mining can provide an effective source of hydrocarbonaceous material with minimal waste and/or reclamation which can be transported to an impoundment and treated.

These methods allow for a large degree of control regarding properties and characteristics of the permeable body which can be designed and optimized for a given installation. Impoundments, individually and across a plurality of impoundments can be readily tailored and classified based on varying composition of materials, intended products and the like. For example, several impoundments can be dedicated to production of heavy crude oil, while others can be configured for production of lighter products and/or syn gas. Non-limiting example of potential classifications and factors can include catalyst activity, enzymatic reaction for specific products, aromatic compounds, hydrogen content, microorganism strain or purpose, upgrading process, target final product, pressure (effects product quality and type), temperature, swelling behavior, aquathermal reactions, hydrogen donor agents, heat superdisposition, garbage impoundment, sewage impoundment, reusable pipes, and others. Typically, a plurality of these factors can be used to configure impoundments in a given project area for distinct products and purposes.

The comminuted hydrocarbonaceous material can be filled into the control infrastructure to form the permeable body in any suitable manner. Typically the comminuted hydrocarbonaceous material can be conveyed into the control infrastructure by dumping, conveyors or other suitable approaches. As mentioned previously, the permeable body can have a carefully tailored high void volume. Indiscriminate dumping can result in excessive compaction and reduction of void volumes. Thus, the permeable body can be formed by low compaction conveying of the hydrocarbonaceous material into the infrastructure. For example, retracting conveyors can be used to deliver the material near a top surface of the permeable body as it is formed. In this way, the hydrocarbonaceous material can retain a significant void volume between particles without substantial further crushing or compaction despite some small degree of compaction which often results from lithostatic pressure as the permeable body is formed.

Once a desired permeable body has been formed within the control infrastructure, heat can be introduced sufficient to begin removal of hydrocarbons, e.g. via pyrolysis. A suitable heat source can be thermally associated with the permeable body. Optimal operating temperatures within the permeable body can vary depending on the composition and desired products. However, as a general guideline, operating temperatures can range from about 200° F. to about 750° F. Temperature variations throughout the encapsulated volume can vary and may reach as high as 900° F. or more in some areas. In one embodiment, the operating temperature can be a relatively lower temperature to facilitate production of liquid product such as from about 200° F. to about 650° F. This heating step can be a roasting operation which results in beneficiation of the crushed ore of the permeable body. Further, the method can optional include controlling the temperature, pressure and other variables sufficient to produce predominantly, and in some cases substantially only, liquid product. Generally, products can include both liquid and gaseous products, while liquid products can require fewer processing steps such as scrubbers etc. The relatively high permeability of the permeable body allows for production of liquid hydrocarbon products and minimization of gaseous products, depending to some extent on the particular starting materials and operating conditions. In one embodiment, the recovery of hydrocarbon products can occur substantially in the absence of cracking within the permeable body.

Heat can be transferred to the permeable body via convection. Heated gases can be injected into the control infrastructure such that the permeable body is primarily heated via convection as the heated gases pass throughout the permeable body. Heated gases can be produced by combustion of natural gas, hydrocarbon product, or any other suitable source. The heated gases can be imported from external sources or recovered from the process of the present invention.

Alternatively, or in combination with convective heating, a highly configurable approach can include embedding a plurality of conduits within the permeable body. The conduits can be configured for use as heating pipes, cooling pipes, heat transfer pipes, drainage pipes, or gas pipes. Further, the conduits can be dedicated to a single function or may serve multiple functions during operation of the infrastructure, i.e. heat transfer and drainage. The conduits can be formed of any suitable material, depending on the intended function. Non-limiting examples of suitable materials can include clay pipes, refractory cement pipes, refractory ECC pipes, poured in place pipes, metal pipes such as cast iron, stainless steel etc., polymer such as PVC, and the like. In one specific embodiment, all or at least a portion of the embedded conduits can comprise a degradable material. For example, non-galvanized 6" cast iron pipes can be effectively used for single use embodiments and perform well over the useful life of the impoundment, typically less than about 2 years. Further, different portions of the plurality of conduits can be formed of different materials. Depending on the intended function, perforations or other apertures can be made in the conduits to allow fluids to flow between the conduits and the permeable body.

The plurality of conduits can be readily oriented in any configuration, whether substantially horizontal, vertical, slanted, branched, or the like. At least a portion of the conduits can be oriented along predetermined pathways prior to embedding the conduits within the permeable body. The predetermined pathways can be designed to improve heat transfer, gas-liquid-solid contacting, maximize fluid delivery or removal from specific regions within the encapsulated volume, or the like. Further, at least a portion the conduits can be dedicated to heating of the permeable body. These heating conduits can be selectively perforated to allow heated gases or other fluids to convectively heat and mix throughout the permeable body. The perforations can be located and sized to optimize even and/or controlled heating throughout the permeable body. Alternatively, the heating conduits can form a closed loop such that heating gases or fluids are segregated from the permeable body. Thus, a "closed loop" does not necessarily require recirculation, rather isolation of heating fluid from the permeable body. In this manner, heating can be accomplished primarily or substantially only through thermal conduction across the conduit walls from the heating fluids into the permeable body. Heating in a closed loop allows for prevention of mass transfer between the heating fluid and permeable body and can reduce formation and/or extraction of gaseous hydrocarbon products.

During the heating or roasting of the permeable body, localized areas of heat which exceed parent rock decomposition temperatures, often above about 900° F., can reduce yields and form carbon dioxide and undesirable contaminating compounds which can lead to leachates containing heavy metals, soluble organics and the like. The heating conduits can allow for substantial elimination of such localized hot spots while maintaining a vast majority of the permeable body within a desired temperature range. The degree of uniformity in temperature can be a balance of cost (e.g. for additional heating conduits) versus yields. However, at least about 85% of the permeable body can readily be maintained within about 5-10% of a target temperature range with substantially no hot spots, i.e. exceeding the decomposition temperature of the hydrocarbonaceous materials such as about 800° F. and in many cases about 900° F. Thus, operated as described herein, the systems can allow for recovery of hydrocarbons while eliminating or substantially avoiding production of undesirable leachates. Although products can vary considerably depending on the starting materials, high quality liquid and gaseous products are possible. For example, crushed oil shale material can produce a liquid product having an API from about 30 to about 45, with about 33 to about 38 being currently typical, directly from the oil shale without additional treatment. Interestingly, it has been found that pressure appears to be a much less influential factor on the quality of recovered hydrocarbons than temperature and heating times. Although heating times can vary considerably, depending on void space, permeable body composition, quality, etc., as a general guideline times can range from a few days (i.e. 3-4 days) up to about one year. In one specific example, heating times can range from about 2 weeks to about 4 months. Under-heating oil shale at short residence times, i.e. minutes to several hours, can lead to formation of leachable and/or somewhat volatile hydrocarbons. Accordingly, extended residence times at moderate temperatures can be used such that organics present in oil shale can be volatilized and/or carbonized, leaving insubstantial leachable organics. In addition, the underlying shale is not generally decomposed or altered which reduces soluble salt formation.

The conduits will generally pass through walls of the constructed infrastructure at various points. Due to temperature differences and tolerances, it can be beneficial to include an insulating material at the interface between the wall and the conduits. The dimensions of this interface can be minimized while also allowing space for thermal expansion differences during startup, steady-state operation, fluctuating operating conditions, and shutdown of the infrastructure. The interface can also involve insulating materials and sealant devices which prevent uncontrolled egress of hydrocarbons or other materials from the control infrastructure. Non-limiting examples of suitable materials can include high temperature gaskets, metal alloys, ceramics, clay or mineral liners, composites or other materials which having melting points above typical operating temperatures and act as a continuation of the permeability control provided by walls of the control infrastructure.

Further, walls of the constructed infrastructure can be configured to minimize heat loss. In one aspect, the walls can be constructed having a substantially uniform thickness which is optimized to provide sufficient mechanical strength while also minimizing the volume of wall material through which the conduits pass. Specifically, excessively thick walls can reduce the amount of heat which is transferred into the permeable body by absorbing the same through conduction. Conversely, the walls can also act as a thermal barrier to somewhat insulate the permeable body and retain heat therein during operation.

In one embodiment, fluid and gas compounds within the permeable body can be altered for desired extractive products using, as an example, induced pressure through gases or piled lithostatic pressure from piled rubble. Thus, some degree of upgrading and/or modification can be accomplished simultaneous with the recovery process. Further, certain hydro carbonaceous materials can require treatment using specific diluents or other materials. For example, treatment of tar sands can be readily accomplished by steam injection or solvent injection to facilitate separation of bitumen from sand particles according to well known mechanisms.

With the above description in mind, FIG. 1 depicts a side view of an engineered capsule containment and extraction impoundment 100 where existing grade 108 is used primarily as support for the impermeable floor layer 112. Exterior capsule impoundment side walls 102 provide containment and can, but need not be, subdivided by interior walls 104. Subdividing can create separate containment capsules 122 within a greater capsule containment of the impoundment 100 which can be any geometry, size or subdivision. Further subdivisions can be horizontally or vertically stacked. By creating separate containment capsules 122 or chambers, classification of lower grade materials, varied gases, varied liquids, varied process stages, varied enzymes or microbiology types, or other desired and staged processes can be readily accommodated. Sectioned capsules constructed as silos within larger constructed capsules can also be designed to provide staged and sequenced processing, temperatures, gas and fluid compositions and thermal transfers. Such sectioned capsules can provide additional environmental monitoring and can be built of lined and engineered tailings berms similar to the primary exterior walls. In one embodiment, sections within the impoundment 100 can be used to place materials in isolation, in the absence of external heat, or with the intent of limited or controlled combustion or solvent application. Lower content hydrocarbon bearing material can be useful as a combustion material, as fill, or as a berm wall building material. Material which does not meet various cut-off grade thresholds can also be sequestered without alteration in an impoundment dedicated for such purpose. In such embodiments, such areas may be completely isolated or bypassed by heat, solvents, gases, liquids, or the like. Optional monitoring devices and/or equipment can be permanently or temporarily installed within the impoundment or outside perimeters of the impoundments in order to verify containment of the sequestered material.

Walls 102 and 104 as well as cap 116 and impermeable layer 112 can be engineered and reinforced by gabions 146 and or geogrid 148 layered in fill compaction. Alternatively, these walls 102, 104, 116 and 112 which comprise the permeability control impoundment and collectively define the encapsulated volume can be formed of any other suitable material as previously described. In this embodiment, the impoundment 100 includes side walls 102 and 104 which are self-supporting. In one embodiment, tailings berms, walls, and floors can be compacted and engineered for structure as well as permeability. The use of compacted geogrids and other deadman structures for support of berms and embankments can be included prior to or incorporated with permeability control layers which may include sand, clay, bentonite clay, gravel, cement, grout, reinforced cement, refractory cements, insulations, geo-membranes, drainpipes, temperature resistant insulations of penetrating heated pipes, etc.

In one alternative embodiment, the permeability control impoundment can include side walls which are compacted earth and/or undisturbed geological formations while the cap and floors are impermeable. Specifically, in such embodiments an impermeable cap can be used to prevent uncontrolled escape of volatiles and gases from the impoundment such that appropriate gas collection outlets can be used. Similarly, an impermeable floor can be used to contain and direct collected liquids to a suitable outlet such the drain system 133 to remove liquid products from lower regions of the impoundment. Although impermeable side walls can be desirable in some embodiments, such are not always required. In some cases, side walls can be exposed undisturbed earth or compacted fill or earth, or other permeable material. Having permeable side walls may allow some small egress of gases and/or liquids from the impoundment. Impermeable walls are formed so as to prevent substantial egress of produced fluids from the impoundment through the impermeable wall during operation of the system.

Above, below, around and adjacent to constructed capsule containment vessels environmental hydrology measures can be engineered to redirect surface water away from the capsule walls, floors, caps, etc. during operation. Further, gravity assisted drainage pipes and mechanisms can be utilized to aggregate and channel fluids, liquids or solvents within the encapsulated volume to central gathering, pumping, condensing, heating, staging and discharge pipes, silos, tanks, and/or wells as needed. In a similar manner, steam and/or water which is intentionally introduce, e.g. for tar sands bitumen treatment, can be recycled.

Once wall structures 102 and 104 have been constructed above a constructed and impermeable floor layer 112 which commences from ground surface 106, the mined rubble 120 (which may be crushed or classified according to size or hydrocarbon richness), can be placed in layers upon (or next to) placed tubular heating pipes 118, fluid drainage pipes 124, and, or gas gathering or injection pipes 126. These pipes can be oriented and designed in any optimal flow pattern, angle, length, size, volume, intersection, grid, wall sizing, alloy construction, perforation design, injection rate, and extraction rate. In some cases, pipes such as those used for heat transfer can be connected to, recycled through or derive heat from heat source 134. Alternatively, or in combination with, recovered gases can be condensed by a condenser 140. Heat recovered by the condenser can be optionally used to supplement heating of the permeable body or for other process needs.

Heat source 134 can derive, amplify, gather, create, combine, separate, transmit or include heat derived from any suitable heat source including, but not limited to, fuel cells, solid oxide fuel cells, solar sources, wind sources, hydrocarbon liquid or gas combustion heaters, geothermal heat sources, nuclear power plant, coal fired power plant, radio frequency generated heat, wave energy, flameless combustors, natural distributed combustors, geothermal heat, or any combination thereof.

In another embodiment, electrically conductive material can be distributed throughout the permeable body and an electric current can be passed through the conductive material sufficient to generate heat. The electrically conductive material can include, but is not limited to, metal pieces or beads, conductive cement, metal coated particles, metal-ceramic composites, conductive semi-metal carbides, calcined petroleum coke, laid wire, combinations of these materials, and the like. The electrically conductive material can be premixed having various mesh sizes or the materials can be introduced into the permeable body subsequent to formation of the permeable body.

Liquids or gases can transfer heat from heat source 134, or in another embodiment, in the cases of hydrocarbon liquid or gas combustion, radio frequency generators (microwaves), fuel cells, or solid oxide fuel cells all can, but need not, actually generate heat inside of capsule impoundment area 114 or 122. In one embodiment, heating of the permeable body can be accomplished by convective heating from hydrocarbon combustion. Of particular interest is hydrocarbon combustion performed under stoichiometric conditions of fuel to oxygen. Stoichiometric conditions can allow for significantly increased heat gas temperatures. The combustion off gases can then be sequestered without the need for further separation, i.e. because the off gas is predominantly carbon dioxide and water.

In order to minimize heat losses, distances can be minimized between the combustion chamber, heat exchanger and impoundments. Therefore, in one specific detailed embodiment portable combustors can be attached to individual heating conduits or smaller sections of conduits.

Alternatively, in-capsule combustion can be initiated inside of isolated capsules within a primary constructed capsule containment structure. This process partially combusts hydrocarbonaceous material to provide heat and intrinsic pyrolysis. Unwanted air emissions 144 can be captured and sequestered in a formation 108 once derived from capsule containment 114, 122 or from heat source 134 and delivered by a drilled well bore 142. Heat source 134 can also create electricity and transmit, transform or power via electrical transmission lines 150. The liquids or gases extracted from capsule impoundment treatment area 114 or 122 can be stored in a nearby holding tank 136 or within a capsule containment 114 or 122. For example, the impermeable floor layer 112 can include a sloped area 110 which directs liquids towards drain system 133 where liquids are directed to the holding tank.

As rubble material 120 is placed with piping 118, 124, 126, and 128, various measurement devices or sensors 132 can be used to monitor temperature, pressure, fluids, gases, compositions, heating rates, density, and other process attributes during the extractive process within, around, or underneath the engineered capsule containment impoundment 100. Such monitoring devices and sensors 132 can be distributed anywhere within, around, part of, connected to, or on top of placed piping 118, 124, 126, and 128 or, on top of, covered by, or buried within rubble material 120 or impermeable barrier walls, floor and/or ceiling.

As placed rubble material 120 fills the capsule treatment area 114 or 122, 120 becomes the ceiling support for engineered impermeable cap barrier zone 138, and wall barrier construction, which may include any combination of impermeability and engineered fluid and gas barrier or constructed capsule construction comprising those which may make up 112 including, but not limited to clay, compacted fill or import material, cement or refractory cement containing material, geo synthetic membrane, liner or insulation. Above 138, fill material 139 is placed to create lithostatic pressure upon the capsule treatment areas 114 or 122. Covering the permeable body with compacted fill sufficient to create an increased lithostatic pressure within the permeable body can be useful in further increasing hydrocarbon product quality. A compacted fill ceiling can substantially cover the permeable body, while the permeable body in return can substantially support the compacted fill ceiling. The compacted fill ceiling can further be sufficiently impermeable to removed hydrocarbon or an additional layer of permeability control material can be added in a similar manner as side and/or floor walls. Additional pressure can be introduced into extraction capsule treatment area 114 or 122 by increasing any gas or fluid once extracted, treated or recycled, as the case may be, via any of piping 118, 124, 126, or 128. Relative measurements, optimization rates, injection rates, extraction rates, temperatures, heating rates, flow rates, pressure rates, capacity indicators, chemical compositions, or other data relative to the process of heating, extraction, stabilization, sequestration, impoundment, upgrading, refining or structure analysis within the capsule impoundment 100 can be acquired through connection to a computing device 130 which operates computer software for the management, calculation and optimization of the entire process. Further, core drilling, geological reserve analysis and assay modeling of a formation prior to blasting, mining and hauling (or at any time before, after or during such tasks) can serve as data input feeds into computer controlled mechanisms that operate software to identify optimal placements, dimensions, volumes and designs calibrated and cross referenced to desired production rate, pressure, temperature, heat input rates, gas weight percentages, gas injection compositions, heat capacity, permeability, porosity, chemical and mineral composition, compaction, density. Such analysis and determinations may include other factors like weather data factors such as temperature and air moisture content impacting the overall performance of the constructed infrastructure. Other data such as ore moisture content, hydrocarbon richness, weight, mesh size, and mineral and geological composition can be utilized as inputs to calculate overall performance of the infrastructure.

Figure 2:
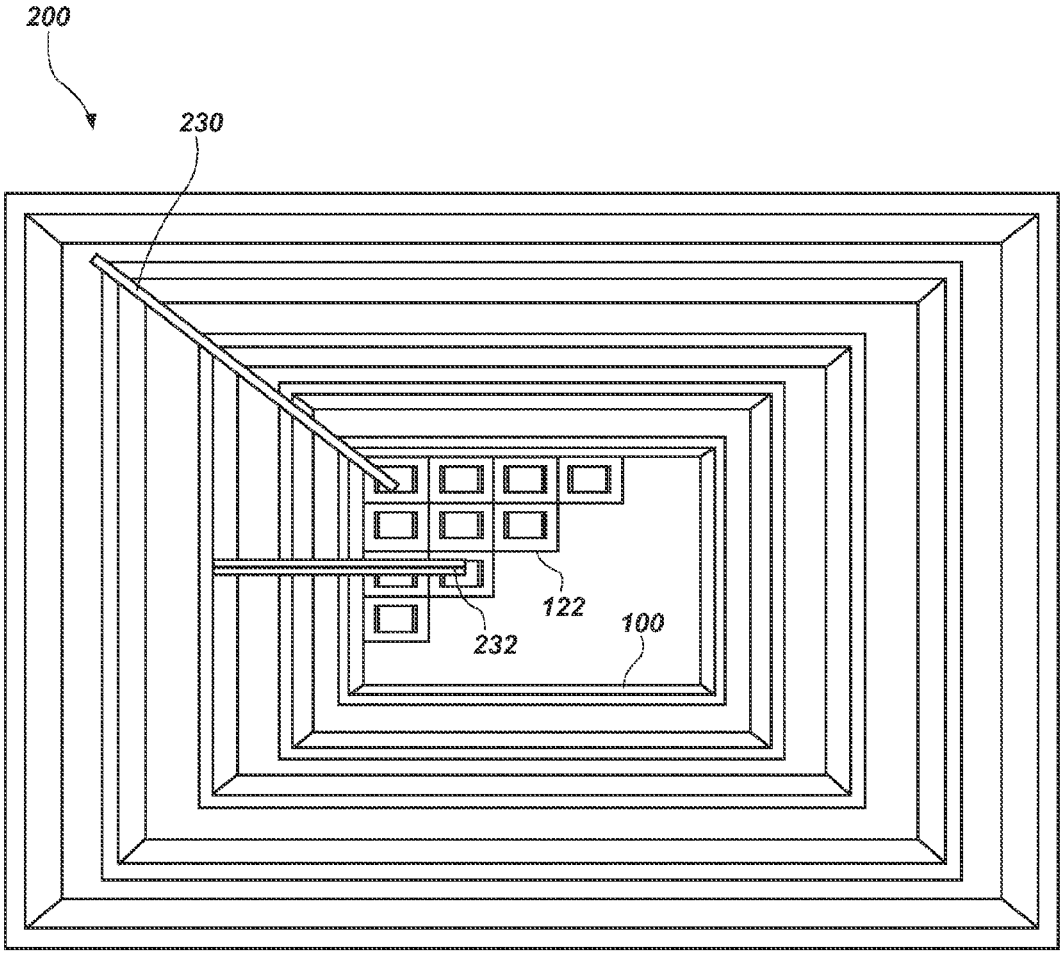
FIG. 2 is a top and plan view of a plurality of permeability control impoundments in accordance with one embodiment of the present invention.

FIG. 2 shows a collection of impoundments including an uncovered or uncapped capsule impoundment 100, containing sectioned capsule impoundments 122 inside of a mining quarry 200 with various elevations of bench mining. In some embodiments, it is envisioned that mining rubble can be transferred down chutes 230 or via conveyors 232 to the quarry capsule impoundments 100 and 122 without any need of mining haul trucks.

Figure 3:
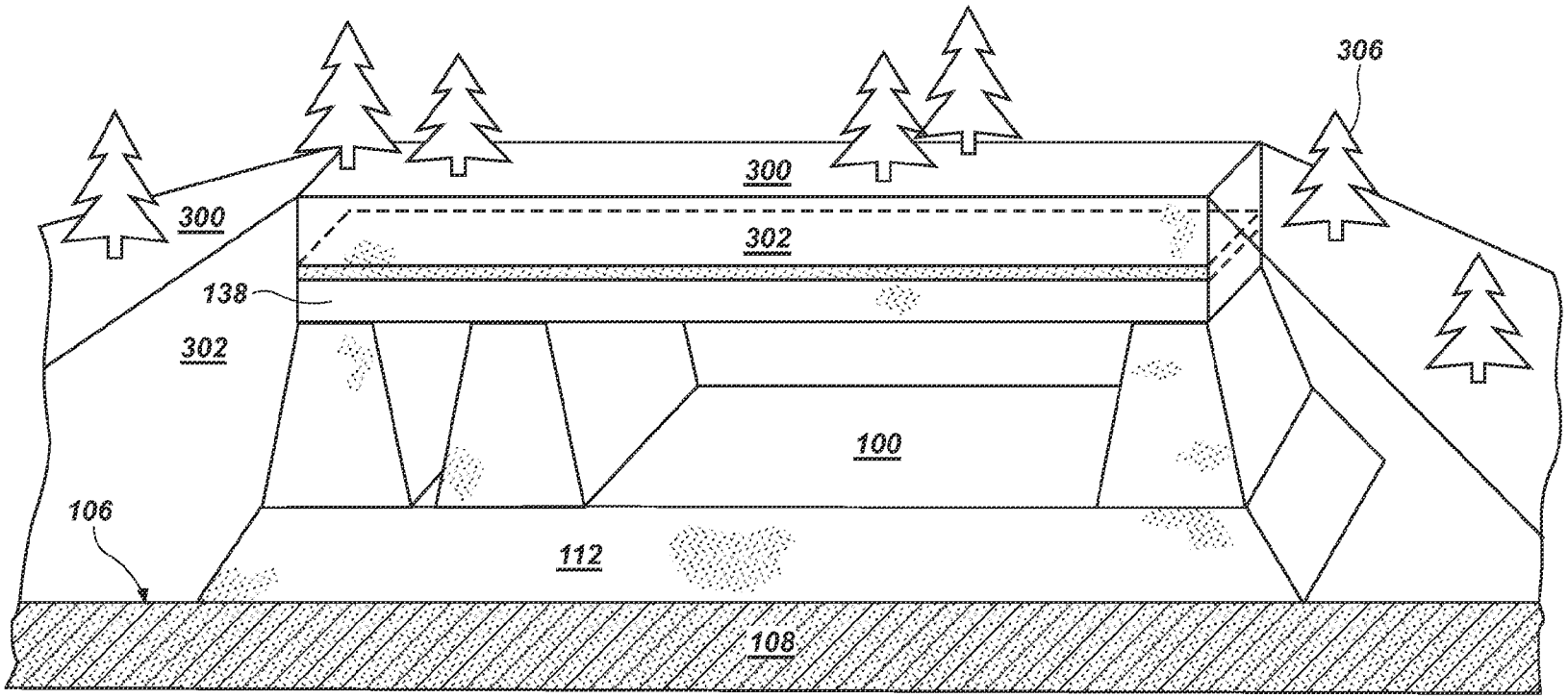
FIG. 3 is a side cutaway view of a permeability control impoundment in accordance with one embodiment of the present invention.

FIG. 3 shows the engineered permeability barriers 112 below capsule impoundment 100 with cap covering material or fill 302 on the sides and top of capsule impoundment 100 to ultimately (following the process) cover and reclaim a new earth surface 300. Indigenous plants which may have been temporarily moved from the area may be replanted such as trees 306. The constructed infrastructures can generally be single use structures which can be readily and securely shut down with minimal additional remediation. This can dramatically reduce costs associated with moving large volumes of spent materials. However, in some circumstances the constructed infrastructures can be excavated and reused. Some equipment such as radio frequency (RF) mechanisms, tubulars, devices and emitters may be recovered from within the constructed impoundment upon completion of hydrocarbon recovery.

Figure 4:
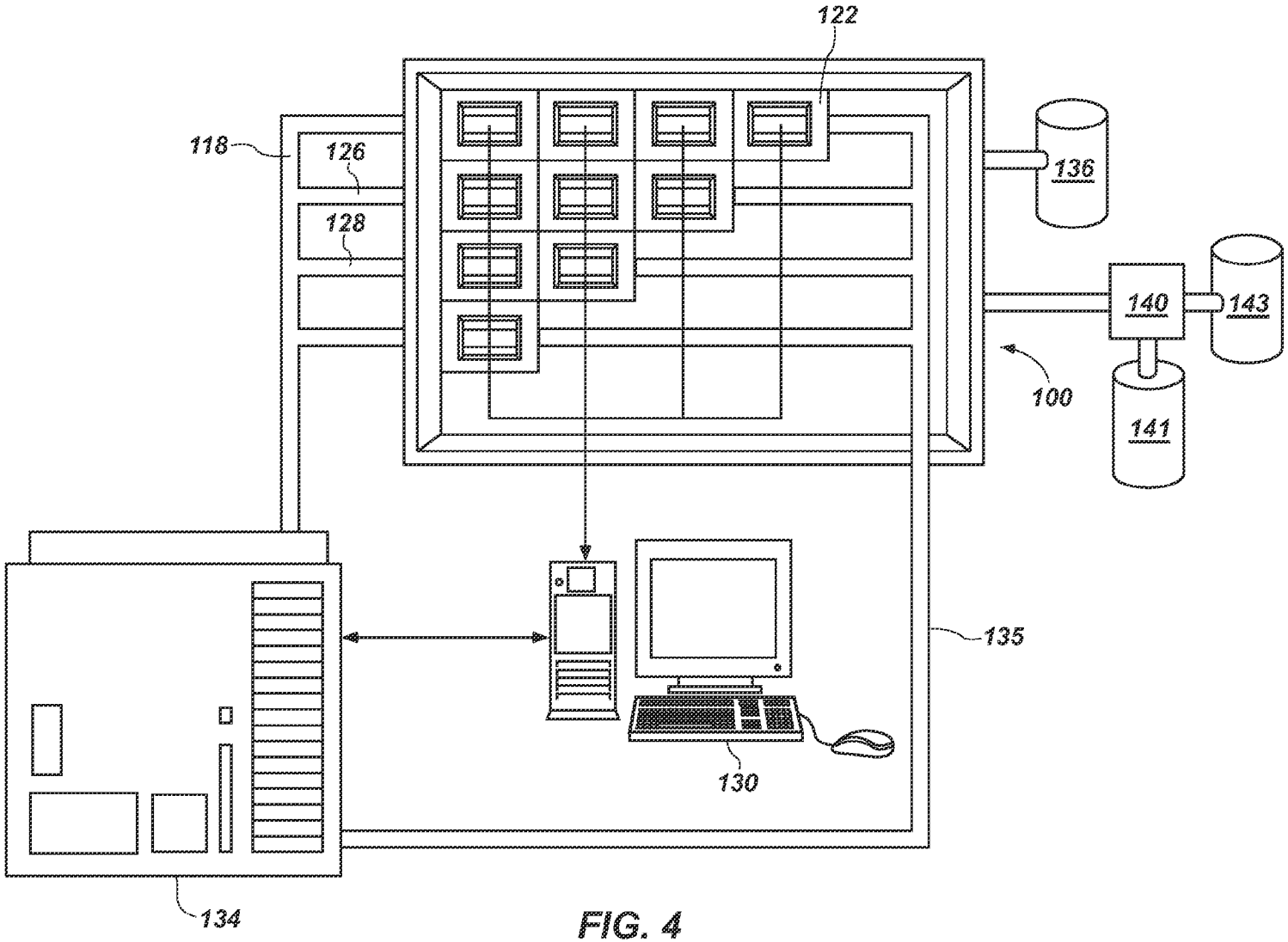
FIG. 4 is a schematic of a portion of a constructed infrastructure in accordance with an embodiment of the present invention.

FIG. 4 shows computer 130 controlling various property inputs and outputs of conduits 118, 126, or 128 connected to heat source 134 during the process among the subdivided impoundments 122 within a collective impoundment 100 to control heating of the permeable body. Similarly, liquid and vapor collected from the impoundments can be monitored and collected in tank 136 and condenser 140, respectively. As described previously, the liquid and vapor products can be combined or more often left as separate products depending on condensability, target product, and the like. A portion of the vapor product can be condensed and combined with the liquid products in tank 136. However, much of the vapor product will be C4 and lighter gases which can be burned, sold or used within the process. For example, hydrogen gas may be recovered using conventional gas separation and used to hydrotreat the liquid products according to conventional upgrading methods, e.g. catalytic, etc. or the non-condensable gaseous product can be burned to produce heat for use in heating the permeable body, heating an adjacent or nearby impoundment, heating service or personnel areas, or satisfying other process heat requirements. The constructed infrastructure can include thermocouples, pressure meters, flow meters, fluid dispersion sensors, richness sensors and any other conventional process control devices distributed throughout the constructed infrastructure. These devices can be each operatively associated with a computer such that heating rates, product flow rates, and pressures can be monitored or altered during heating of the permeable body. Optionally, in-place agitation can be performed using, for example, ultrasonic generators which are associated with the permeable body. Such agitation can facilitate separation and pyrolysis of hydrocarbons from the underlying solid materials with which they are associated. Further, sufficient agitation can reduce clogging and agglomeration throughout the permeable body and the conduits.

Suitable conduits can be used to transfer heat in any form of gas, liquid or heat via transfer mechanisms from any sectioned capsule impoundment to another. Then, cooled fluid can be conveyed via heat transfer mechanisms to the heat originating capsule, or heat originating source to pick up more heat from the capsule to be again recirculated to a destination capsule. Thus, various conduits can be used to transfer heat from one impoundment to another in order to recycle heat and manage energy usage to minimize energy losses.

Figure 5:
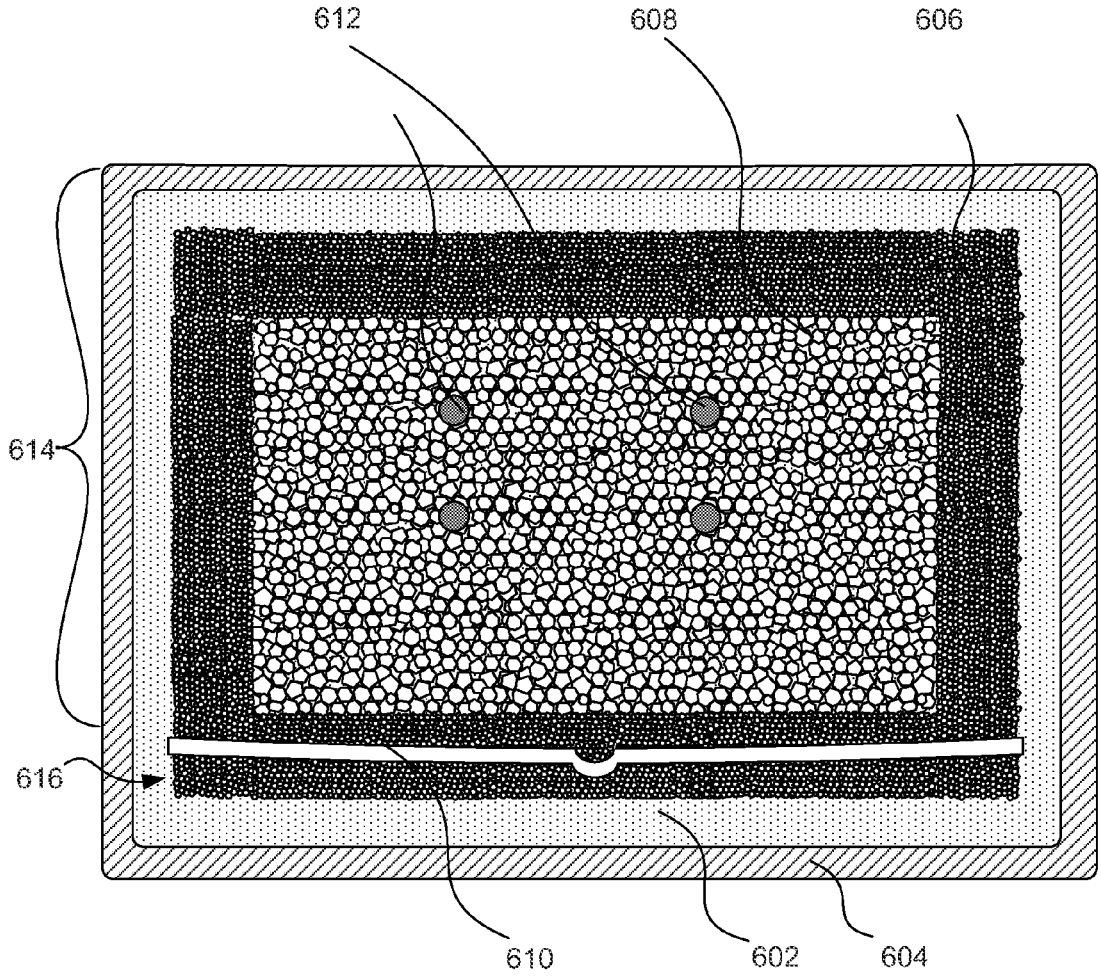
FIG. 5 is a side cutaway view of a permeability control impoundment in accordance with one embodiment of the present invention.

Referring to FIG. 5, a fluid barrier layer 602 of bentonite amended soil (BAS) is formed adjacent native formation 604 or other structure (e.g. an adjacent impoundment). A layer of gravel fines 606 is also provided adjacent the BAS layer to form an insulating layer. Encapsulated within the layer of gravel fines is a permeable body 608 of comminuted oil shale forming a production volume having an average particle size which is suitable for production of hydrocarbons. Typically, the gravel fines layer can comprise crushed oil shale having an average particle size substantially smaller than the average particle size within the production volume. Although other sizes may be suitable, the gravel fines layer can have average particle size from 1/16 inch to 6 inches and often from about 1/8 inch to 2 inches. A primary liquid collection system 610 can be oriented within a lower portion of the crushed oil shale within the layer of gravel fines. Although the primary liquid collection system is shown in the gravel layer midway between the permeable body and the BAS layer, such location is for illustration purposes and is not intended to be limiting. As such, the primary liquid collection system can located approximately midway, in the upper portion of the gravel layer, or in the lower portion of the gravel layer. The liquid collection system can be configured to collect fluids across the entire cross-section of the permeable body. The collections system can be a single continuous layer, or may be formed of multiple discrete collection trays. In one example, the liquid collection system can be a drain pan which extends through the layer of gravel fines to the surrounding BAS layer such that the pan spans an entire horizontal plane of the permeable body. The drain pan can optionally include one or more drain channels which direct fluid toward a common collection point for removal via a corresponding outlet.

Although removal can be accomplished via pumping, typically gravity drainage can provide sufficient removal flow rates. In one aspect, the drain pan can cover the entire floor of the infrastructure. A plurality of heating conduits 612 can be embedded within the permeable body so as to heat the oil shale sufficient to initiate pyrolysis and production of hydrocarbons.

During operation, the permeable body of hydro carbonaceous material is heated to a predetermined production temperature corresponding to liberation and/or production of hydrocarbons from the corresponding hydrocarbonaceous material in the production zone 614. However, the entire system exhibits temperature gradients which vary throughout. For example, for oil shale processing, the permeable body may have a peak bulk temperature around 750° F. with a decreasing temperature gradient approaching the surrounding formation which is often around 60° F. Notably, the primary liquid collection system is oriented such that fluids may be produced and/or collected below the primary liquid collection system. This can happen if temperatures below the primary liquid collection system a production temperature sufficient to produce hydrocarbons. Further, during operation the materials below the primary liquid collection system are cooler than the bulk temperature of the permeable body. As such, gases which are formed can circumvent the primary system and condense within the cooler material below.

Long term collection of flowable liquids or other fluids in the non-production zone 616 below the primary drain can cause problems. For example, when using BAS as the barrier layer 602, as the BAS layer dehydrates over time, the barrier properties fade such that any flowable liquids can then escape into surrounding earth 604. Fortunately, the crushed materials in the non-production zone can also retain a limited amount of liquid via surface tension and interfacial capillary mechanisms. In this manner some amount of liquids can be tolerated within the non-production zone as long as such liquids can be retained in a non-flowable condition.

In order to decrease or eliminate the amount of liquids retained in the non-production zone, several conditions can be created and maintained. During operation of the system, temperatures below the liquid collection system can be maintained below a production temperature for the corresponding hydro carbonaceous materials. As a result, materials in the non-production zone do not produce hydrocarbons. Further, the fluid barrier properties of the BAS layer can be maintained as long as the BAS layer is hydrated. Upon dehydration, the BAS layer reverts to a particulate state allowing fluids to pass. During operation, hydration can be maintained by keeping temperatures throughout the BAS layer below 200° F. Additionally, the infrastructures can optionally further include hydration mechanisms to supply water to the BAS layer. Such hydration mechanisms can include conduits, piping, and/or irrigation channels to provide water throughout the BAS layer. Such hydration mechanisms can be located in discrete locations or continuously around the perimeter of the infrastructure such that adequate hydration of the BAS layer is achieved so as to preserve substantial fluid impermeability during operation.

Figure 6:
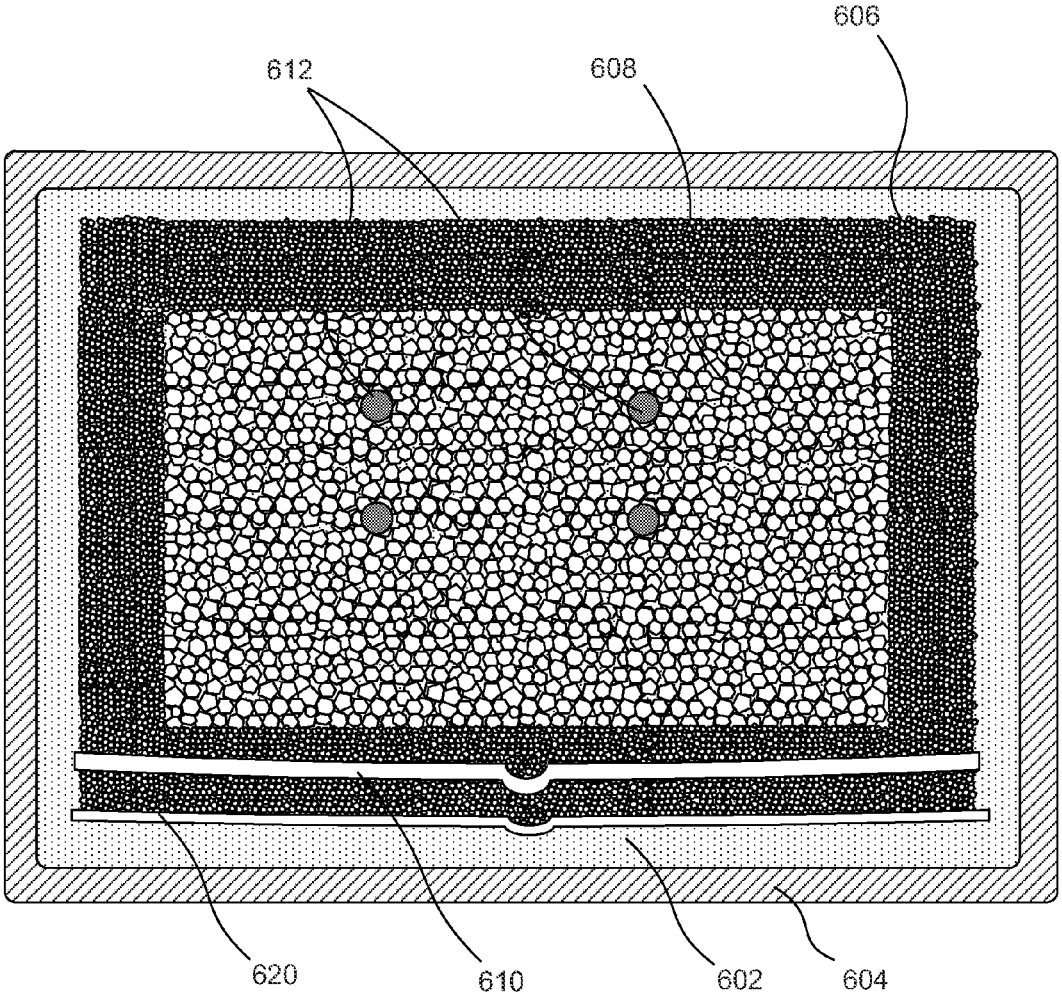
FIG. 6 is a side cutaway view of a permeability control impoundment in accordance with one embodiment of the present invention.

Referring to FIG. 6, a fluid barrier layer 602 of bentonite amended soil (BAS) is formed adjacent native formation 604 or other structure (e.g. an adjacent impoundment). A layer of gravel fines 606 is also provided adjacent the BAS layer to form an insulating layer. The layer of gravel fines is formed of gravel, often oil shale or hydrocarbonaceous material, having an average particle size smaller than the permeable body 608. Most often the gravel fines can have an average particle size from about ⅛ inch to about 2 inches, although other sizes can be suitable. Within the layer of gravel fines is the permeable body of comminuted oil shale forming a production volume having an average particle size which is suitable for production of hydrocarbons. A primary liquid collection system 610 can be oriented within a lower portion of the crushed oil shale within the layer of gravel fines. Additionally, a secondary liquid collection system 620 can be located below the primary liquid collection system 610. The secondary liquid collection system can have a larger surface area than the primary liquid collection system. In one aspect, the secondary liquid collection system can circumscribe the primary liquid collection system. The secondary liquid collection system can also be a drain pan which extends through the layer of gravel fines to the BAS layer. In one aspect, the drain pan can cover the entire floor of the infrastructure. Additionally, the secondary liquid collection system can located approximately midway, in the upper portion of the gravel layer, or in the lower portion of the gravel layer. As shown in FIG. 6, in one aspect, the secondary liquid collection system can be located between the layer of gravel fines and the BAS layer.

Figure 7:
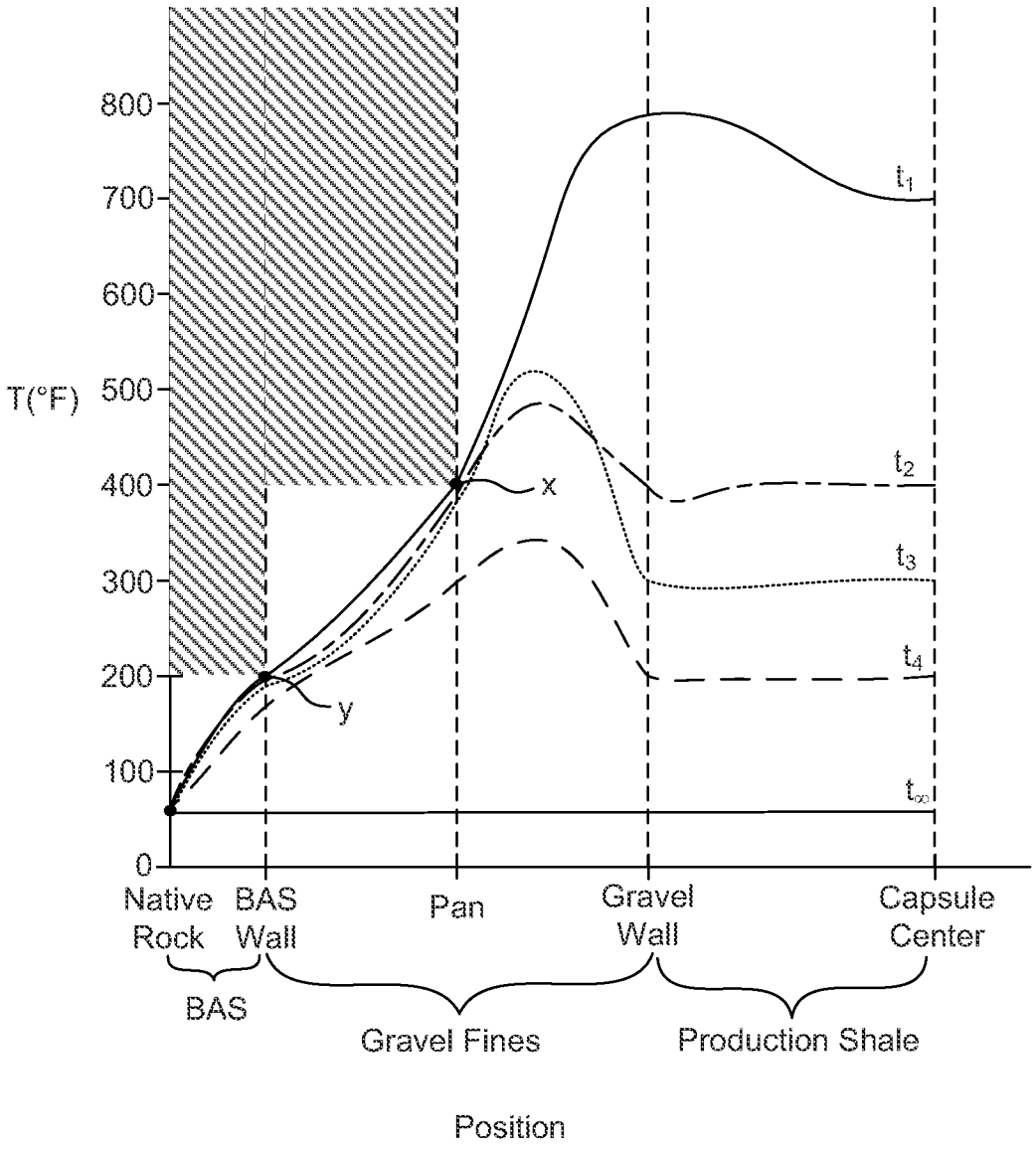
FIG. 7 is a temperature profile for various components of the constructed permeability control infrastructure in accordance with an embodiment of the present invention.

Referring to FIG. 7, a temperature profile across the permeable body and surrounding encapsulation is shown for several times ($t_1$, $t_2$, $t_3$, $t_4$, and $t_\infty$). The following discussion is specifically for oil shale, but similar operational profiles exist for other hydro carbonaceous materials where the production temperatures vary depending on the material. Initially, $t_1$ shows a temperature profile of a fully operational system in a production phase. Specifically, temperature of the bulk material within the permeable body is around 700-750° F. for oil shale which produces hydrocarbons at a desirable rate. Oil shale, for example, begins to produce hydrocarbons around 400° F. One purpose of the gravel fines layer and BAS layer are to provide a heat insulating function so that temperatures can be reduced in a controlled manner within the system so as to minimize thermal effects on surrounding earth or materials. Consequently, a temperature gradient can be maintained across the gravel fines layer such that near the gravel wall interface with the bulk production zone, temperatures can be near the bulk temperatures. During operation ($t_1$) the temperature gradient within the gravel fines layer can be maintained to keep temperatures at the primary drain assembly below a production temperature (i.e. about 400° F.). Further, temperature at the interface between the BAS layer and the gravel fines layer can be maintained below 200° F. to prevent dehydration of the BAS layer. Ultimately, temperature from the BAS interface can decrease across the BAS layer to a surrounding native temperature (e.g. 60° F.). Temperature at the BAS-formation interface can be elevated slightly from native formation temperature; however, such elevated temperatures can be minimized. Typically, it is desirable to keep the temperature at the BAS-formation interface within about 50° F., and in some cases within about 20° F. of the native formation temperature.

Temperature at the primary drain assembly and the BAS layer can be controlled by adjusting heating rates from the bulk heating conduits, varying void space within the permeable body, varying thickness of the gravel fines layer, and adjusting the fluid removal rates via the drain system. Optional supplemental cooling loops can be provided to remove heat from near the primary drain assembly and/or the BAS layer to avoid production of flowable hydrocarbons within the non-production zone. The term "flowable hydrocarbon" is intended to cover hydrocarbons which are in excess of a retention capacity of the material.

Referring again to FIG. 7, shutdown of the process can involve a careful balance of variables in order to avoid inadvertent production or collection of hydrocarbons in the non-production zone. The scenario illustrated is one exemplary temperature profile during shutdown such that variations can be made for different materials or conditions and specific temperatures can vary. Once the bulk permeable body is nearly depleted of recoverable hydrocarbons, circulating heating fluids through the conduits can be replaced with a circulating cooling fluid to initiate cooling throughout the system. Thus, at an initial shutdown stage $t_2$ the bulk permeable body temperature can be reduced (e.g. to 400° F.) while cooling in the gravel fines layer lags behind since heat may be removed faster near the cooling conduits than the surrounding gravel fines layer. As such, the temperature at the gravel wall can also be about the bulk temperature (e.g. 400° F.) with a decreasing temperature gradient across the gravel fines layer. In this example, temperature can range from about 400° F. to about 200° F. at the BAS interface, with temperatures at the primary drain assembly below 400° F., shown in FIG. 7 as point X. Notably, due to rapid cooling in the bulk material, the temperatures between the gravel wall and primary drain assembly can exceed the bulk temperature (e.g. be above 400° F.). Further, materials above the production temperature continue to produce hydrocarbons and heat while removal rates of fluid via the primary drain assembly decrease as the bulk permeable body ceases to produce hydrocarbons. Consequently, the temperature profile within the gravel fines layer can temporarily increase as illustrated by intermediate shutdown phase $t_3$. During intermediate phase at $t_3$, temperatures between the gravel wall and primary drain assembly can temporarily increase above conditions at $t_2$. Throughout a subsequent final shutdown phase $t_4$, temperatures continue to fall throughout the system such that temperature conditions at the primary drain assembly are well below the production temperature, the temperature at the BAS interface is below 200° F., shown in FIG. 7 as point Y, and temperature at the native formation is substantially that of surrounding formation. Ultimately, as heat is fully and completely dissipated, temperatures substantially align with surrounding native temperatures as illustrated by $t_\infty$ over a period of months or years. Once flowable hydrocarbons are removed from the production zone and production has ceased, the fluid barrier properties of the barrier layer (e.g. BAS) are typically no longer necessary. As such, a BAS layer can be allowed to dehydrate or otherwise degrade without releasing flowable hydrocarbons or other undesirable materials into surrounding formation.

In one embodiment, extracted crude has fines precipitated or trapped within the product. Such fines can cause undesirable difficulties in further refining or use. As such, extracted fluids and gases can be treated for the removal of fines and dust particles. Separation of fines from shale oil can be accomplished by techniques such as, but not limited to, hot gas filtering, precipitation, and heavy oil recycling.

Hydrocarbon products recovered from the permeable body can be further processed (e.g. refined) or used as produced. Any condensable gaseous products can be condensed by cooling and collection, while non-condensable gases can be collected, burned as fuel, reinjected, or otherwise utilized or disposed of. Optionally, mobile equipment can be used to collect gases. These units can be readily oriented proximate to the control infrastructure and the gaseous product directed thereto via suitable conduits from an upper region of the control infrastructure.

In yet another alternative embodiment, heat within the permeable body can be recovered subsequent to primary recovery of hydrocarbon materials therefrom. For example, a large amount of heat is retained in the permeable body subsequent to production and slowly dissipates into surrounding formation. In one optional embodiment, the permeable body can be flooded with a heat transfer fluid such as water to form a heated fluid, e.g. heated water and/or steam. At the same time, this process can facilitate removal of some residual hydrocarbon products via a physical rinsing of the spent shale solids. In some cases, the introduction of water and presence of steam can result in water gas shift reactions and formation of synthesis gas. Steam recovered from this process can be used to drive a generator, directed to another nearby infrastructure, or otherwise used. Hydrocarbons and/or synthesis gas can be separated from the steam or heated fluid by conventional methods.

Synthesis gas can also be recovered from the permeable body during the step of heating. Various stages of gas production can be manipulated through processes which raise or lower operating temperatures within the encapsulated volume and adjust other inputs into the impoundment to produce synthetic gases which can include but are not limited to, carbon monoxide, hydrogen, hydrogen sulfide, hydrocarbons, ammonia, water, nitrogen or various combinations thereof. In one embodiment, temperature and pressure can be controlled within the permeable body to lower $CO_2$ emissions as synthetic gases are extracted.

Hydrocarbon product recovered from the constructed infrastructures can most often be further processed, e.g. by upgrading, refining, etc. Sulfur from related upgrading and refining processing can be isolated in various constructed sulfur capsules within the greater structured impoundment capsule. Constructed sulfur capsules can be spent constructed infrastructures or capsules which are dedicated for the purpose of storage and isolation after desulfurization.

Similarly, spent hydrocarbonaceous material remaining in the constructed infrastructure can be utilized in the production of cement and aggregate products for use in construction or stabilization of the infrastructure itself or in the formation of offsite constructed infrastructures. Such cement products made with the spent shale may include, but are not limited to, mixtures with Portland cement, calcium, volcanic ash, perlite, synthetic nanocarbons, sand, fiber glass, crushed glass, asphalt, tar, binding resins, cellulosic plant fibers, and the like.

In still another embodiment, injection, monitoring and production conduits or extraction egresses can be incorporated into any pattern or placement within the constructed infrastructure. Monitoring wells and constructed geo membrane layers beneath or outside of the constructed capsule containment can be employed to monitor fluid and moisture migration outside of containment boundaries and the constructed infrastructure.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A method of reducing residual hydrocarbon accumulation during processing, comprising:

a) forming a permeable body of a comminuted hydrocarbonaceous material within an enclosure forming a control infrastructure, wherein a primary liquid collection system is located in a lower portion of the permeable body, said primary liquid collection system having an upper surface for collecting and removing liquids and wherein comminuted hydrocarbonaceous material below the primary liquid collection system forms a non-production zone; and b) heating at least a portion of the permeable body to a bulk temperature above a production temperature sufficient to remove hydrocarbons therefrom, wherein conditions in the non-production zone are maintained below the production temperature and the permeable body remains substantially stationary during heating.

2. The method of claim 1, further comprising collecting and removing the hydrocarbons.

3. The method of claim 2, wherein the step of collecting and removing the hydrocarbons includes collecting a liquid product from a lower region of the control infrastructure and collecting a gaseous product from an upper region of the control infrastructure.

4. The method of claim 1, wherein the production temperature ranges from 400° F. to 900° F.

5. The method of claim 1, wherein the permeable body includes a secondary liquid collection system located below the primary liquid collection system.

6. The method of claim 1, wherein the upper surface of the primary liquid collection system spans an entire floor of the enclosure.

7. The method of claim 1, wherein the control infrastructure at least partially comprises an earthen material.

8. The method of claim 7, wherein the earthen material includes clay, bentonite clay, compacted fill, refractory cement, cement, bentonite amended soil, or combinations thereof.

9. The method of claim 1, wherein the control infrastructure is formed in direct contact with walls of an excavated hydrocarbonaceous material deposit.

10. The method of claim 1, wherein the control infrastructure is free-standing.

11. The method of claim 1, wherein the mined comminuted hydrocarbonaceous material comprises oil shale, tar sands, coal, lignite, bitumen, peat, or combinations thereof.

12. The method of claim 1, wherein the permeable body consists essentially of crushed hydrocarbonaceous material having an average size from about 6 inches to about 2 feet.

13. The method of claim 1, wherein the permeable body has a void space from about 10% to about 40% a total volume of the permeable body.

14. The method of claim 1, wherein the permeable body further comprises a plurality of conduits embedded within the permeable body, at least some of said conduits being configured as horizontal heating pipes.

15. The method of claim 14, wherein the heating conduits are fluidly coupled to a heat source and further comprising circulating a heating fluid in a closed loop through the heating conduits sufficient to prevent substantial mass transfer between the heating fluid and the permeable body.

16. The method of claim 1, wherein the comminuted hydrocarbonaceous material is crushed oil shale and the heating is performed under time and temperature conditions sufficient to form a liquid hydrocarbon product having an API from about 30 to about 45.

17. A constructed permeability control infrastructure, comprising:

a) a permeability control impoundment defining a substantially encapsulated volume;

b) a comminuted hydrocarbonaceous material within the encapsulated volume forming a permeable body of hydrocarbonaceous material; and c) a primary liquid collection system located in a lower portion of the permeable body, said primary liquid collection system having an upper surface for collecting and removing liquids and wherein comminuted hydrocarbonaceous material below the primary liquid collection system forms a non-production zone.

18. The infrastructure of claim 17, wherein the permeability control impoundment is substantially free of undisturbed geological formations.

19. The infrastructure of claim 17, wherein the upper surface of the primary liquid collection system spans an entire floor of the permeability control impoundment.

20. The infrastructure of claim 17, further comprising a secondary liquid collection system located below the primary liquid collection system.

21. The infrastructure of claim 17, wherein the permeability control impoundment comprises an earthen material.

22. The infrastructure of claim 17, wherein the control infrastructure is freestanding.

23. The infrastructure of claim 17, further comprising a compacted fill ceiling substantially covering the permeable body, said compacted fill ceiling being substantially supported by the permeable body.

24. The infrastructure of claim 17, wherein the comminuted hydro carbonaceous material comprises oil shale, tar sands, coal, lignite, bitumen, peat, or combinations thereof.

25. The infrastructure of claim 17, wherein the permeable body has a void space from 10% to about 40% of a total volume of the permeable body.

26. The infrastructure of claim 17, further comprising a gaseous heat source operatively connected to the permeability control impoundment and configured to direct a heated gas to the permeable body for convective heating thereof.

27. The infrastructure of claim 17, further comprising a plurality of conduits embedded within the permeable body, at least some of the plurality of conduits being horizontal heating conduits.

* * * * *